US007464821B2

(12) United States Patent
Gallia

(10) Patent No.: US 7,464,821 B2
(45) Date of Patent: Dec. 16, 2008

(54) SCREEN ASSEMBLY FOR VIBRATORY SCREENING MACHINE

(76) Inventor: Robert L. Gallia, 7839 US Highway 77 South, Hallettsville, TX (US) 77964

( * ) Notice: Subject to any disclaimer, the term of this patent is extended or adjusted under 35 U.S.C. 154(b) by 57 days.

(21) Appl. No.: 11/542,860

(22) Filed: Oct. 4, 2006

(65) Prior Publication Data

US 2008/0083660 A1 Apr. 10, 2008

(51) Int. Cl.
*B07B 1/46* (2006.01)

(52) U.S. Cl. ..... 209/399; 209/403

(58) Field of Classification Search ..... 209/397, 209/399, 401, 403

See application file for complete search history.

(56) References Cited

U.S. PATENT DOCUMENTS

| | | | |
|---|---|---|---|
| 4,033,865 | A | 7/1977 | Derrick |
| 4,575,421 | A | 3/1986 | Derrick |
| 5,221,008 | A | 6/1993 | Derrick |
| 5,330,057 | A | 7/1994 | Schiller |
| 5,385,669 | A | 1/1995 | Leone |
| 5,417,859 | A | 5/1995 | Bakula |
| 5,673,797 | A | 10/1997 | Bakula |
| 5,876,552 | A | 3/1999 | Bakula |
| 6,119,868 | A | 9/2000 | Hiltl |
| 6,202,856 | B1 | 3/2001 | Carr |
| 2005/0236305 | A1 | 10/2005 | Schulte |

*Primary Examiner*—Joseph C Rodriguez
(74) *Attorney, Agent, or Firm*—G. Turner Moller

(57) ABSTRACT

A screen assembly for a conventional vibratory screening machine includes a series of screens bonded to a rigid rectangular metal frame having rectangular tubular frame members and at least two and no more than ten intermediate frame members. This leaves a series of permeable areas through the screen assembly that are in the range of 2-32% of the overall area of the screen assembly. The screens include an upper fine mesh screen which passes particles below a predetermined size and rejects particles above this size. A second or blinding screen, below the first screen, acts to dislodge particles caught in the mesh of the first screen. A load bearing assembly supports the first and second screens and includes a first support screen coarser than the screens above it, a bonding layer and a second support screen coarser than the first support screen.

14 Claims, 1 Drawing Sheet

SCREEN ASSEMBLY FOR VIBRATORY SCREENING MACHINE

This invention relates to a screen for a vibratory screening machine and, more particularly, to a screen having improved throughput and longer life.

BACKGROUND OF THE INVENTION

As explained in U.S. Pat. No. 6,209,726, vibratory screening machines are well known in the art and are used in a variety of situations where it is desired to remove suspended solids from a slurry. A common situation where these are used are in the drilling of oil and gas wells where drilled solids are circulated to the surface by drilling mud. Although the screen assembly of this invention has utility in other applications, it will be described in connection with the removal of drilled solids from drilling mud where the vibratory screening machines are called shale shakers.

Conventional vibratory screening machines include a rectangular screen assembly that is vibrated. The liquid slurry is discharged onto the screen which is typically inclined so solids in the slurry, larger than the screen size, collect on top of the screen and migrate toward the discharge end, typically off one of the longer sides. Solids in the slurry smaller than the screen size pass with the liquid through the screen.

Early shale shakers incorporated a single inclined vibrating layer of hardware cloth having a mesh opening of ¼-⅜". Drilling mud coming from the well discharged onto the inclined screen. Large shale particles collected on top of the hardware cloth and travelled down the incline into a shale pit. The liquid drilling mud and the bulk of the entrained solids passed into the mud system.

Substantial improvements have been made in vibratory screening machines so very small solids are now capable of being removed from hot drilling mud streams emitting from wells being drilled at substantial depths in the earth. Larger drilling rigs are equipped with sophisticated mud systems that treat the drilling mud to perform its various tasks. A typical large drilling rig includes a shale shaker mounted on a mud tank so the removed solids are discharged into a shale pit adjacent the mud tank and the liquid mud passing through the shale shaker falls into the mud tank where it is treated by monitoring various properties, by adding various chemicals and by using other solids removal techniques such as cyclones, centrifuges and the like.

When starting the drilling of a land based well, however deep, the surface hole is typically drilled with a combination of water and bentonite gel which combines with drilled solids to make a native drilling mud. This type mud is not expensive and is not treated in a costly manner. When drilling surface hole, the screen assemblies on the shake shaker are selected to have rather large mesh so that only fairly large solids are removed from the mud stream. Because the screen assemblies have large mesh screen, they have screen wire of substantial diameter and are accordingly robust and operate satisfactorily for substantial lengths of time.

As the well is deepened, the drilling mud is treated with more expensive chemicals and more care is taken to control the amount and size of solids in the recirculated mud. In the drilling of a typical deep well, one or more strings of intermediate pipe are cemented in the hole to provide protection against blow outs. Typically, more expensive mud types are used following the setting of intermediate strings. For example, it is common in parts of South Texas to drill a well with a water based gel mud until an intermediate string of pipe is set and then change over to an oil based invert emulsion.

These oil based emulsions are considerably more expensive than the water based mud used to drill the shallower part of the hole. Considerably more care is taken to remove solids from more expensive muds, of which oil based invert emulsions are typical.

The screen assemblies in shale shakers are accordingly changed during drilling of wells to provide larger mesh, less expensive, more durable screen assemblies when drilling the shallow part of the hole and smaller mesh, more expensive, less durable screen assemblies when drilling the deeper part of the hole. The trend, over time, has been to use finer and finer mesh screens when using expensive muds. The finest screen mesh commonly presently employed in screen assemblies is on the order of 210-250 mesh, which means there are 210-250 strands of wire per inch. A conventional 210 mesh screen will remove solids larger than 74 microns from drilling mud. Occasionally, mesh sizes up to 280 strands of wire per inch are used in special situations, such as drilling with brine.

There are presently several types of screen assemblies employed in sophisticated vibratory screening machines used as shale shakers. One type employs a metal plate as a support for the screens where the screens are bonded in one fashion or other to the metal plate. A second type is shown in U.S. Pat. No. 6,209,726 and employs four screens and a perforate plastic mesh that bonds the screens together.

As shown in FIG. 1, a third type prior art screen assembly 10 includes a rectangular metal frame 12, a fine mesh top screen 14, a blinding screen 16, a plastic grid or mesh 18 and a load bearing screen 20. The frame 12 includes a rectangle of tubular members 22 and a series of short tubular members 24 spanning the short dimension of the screen assembly 10. The plastic mesh 18 includes a peripheral section 26 overlying the rectangular members 22 and a series of strips 28 overlying the short tubular members 24 an perforate panels 30 spanning between the strips 28 and members 24. The openings 32 in the perforate panels 30 may vary somewhat but are almost always between 1" square and 2" square, meaning that the openings are square either 1" or 2" on a side. The frame 12, the screens 14, 16, 20 and the plastic mesh 18 are put into a heated press where the temperature softens the plastic mesh 18 and an applied pressure squeezes the screens 14, 16, 20 into the plastic mesh 18, or vice versa, thereby bonding the layers together to provide a unitary structure. When inspecting a manufactured screen assembly 10, it is difficult to determine whether the plastic mesh 20 started out between the screens 14, 16 or between the screens 16, 20 or between the screen 20 and the frame 12 because the plastic is so completely intermeshed with the screens. Screen assemblies of this construction have proved suitable for use in the shallower part of hole where the upper screen 14 is on the order of 140 mesh or coarser.

As shown in FIG. 2, another prior art screen assembly 34 includes a rectangular frame 36 having made of tubular members 38 and including intermediate members 40 parallel to the short dimension of the frame 36. A bead 42 of epoxy is applied to the tubular members 38, 40. A fine mesh screen 44, a blinding screen 46 and a support screen 48 are tensioned and then applied to the epoxied frame 36 with a suitable amount of pressure so the epoxy 42 becomes dispersed through the screens 46, 48 and sets up.

Disclosures of interest relative to this invention are found in U.S. Pat. Nos. 4,033,865; 4,575,451; 5,221,008; 5,330,057; 5,417,859 and 5,673,797.

SUMMARY OF THE INVENTION

In this invention, the load bearing or support assembly for the operative screens comprises a rigid metal frame having one or more cross pieces and two or more screens bonded to the metal frame. In one embodiment of this invention, an upper fine mesh screen is underlain by a coarser blinding screen. These screens are underlain by a load bearing assembly comprising a first support screen coarser than the blinding screen, a bonding material, a second support screen coarser than the first support screen and the metal frame. The bonding material may be an adhesive or, preferably a plastic layer. The screens, plastic layer and metal frame are placed in a heated press where the plastic is softened and pressure is applied to distort the plastic and bond the screens and plastic together. The metal frame is sized so the assembly fits into a conventional vibratory screening machine or shale shaker.

In use, the upper fine mesh screen rejects the oversized particles and passes the finer particles and liquid, the blinding screen acts to dislodge any particles sticking in the mesh of the upper screen and the load bearing assembly supports the upper screens against the forces imparted by the liquid passing through the screens and by the vibration of the screen assembly.

It is an object of this invention to provide an improved screen assembly of improved durability for use in a vibratory screening machine.

Another object of this invention is to provide an improved screen assembly which incorporates an improved support for the operating screens providing improved durability and improved throughput.

A more specific object of this invention to provide an improved screen assembly incorporating a metal frame and at least two screens in a load bearing assembly used to support a fine mesh screen and a blinding screen.

These and other objects and advantages of this invention will become more fully apparent as this description proceeds, reference being made to the accompanying drawings and appended claims.

DETAILED DESCRIPTION

Figure 5:
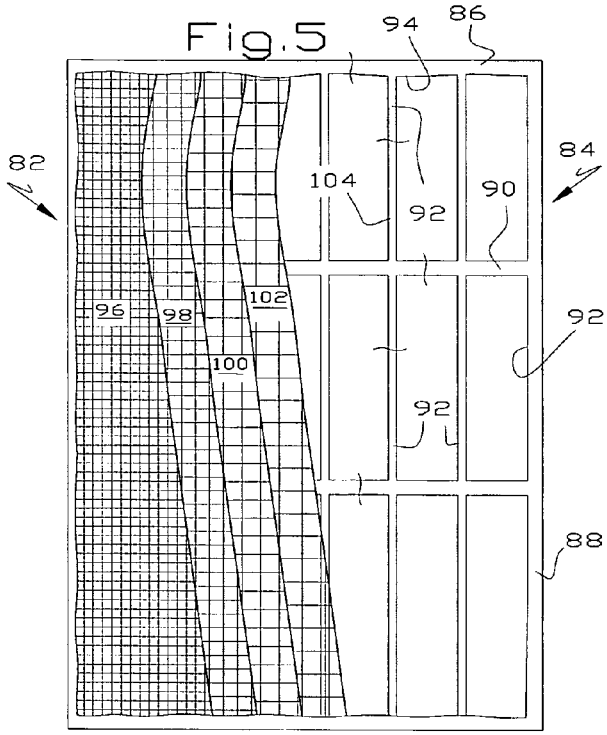
FIG. 5 is an isometric view of another frame showing another pattern of rigid supports.
Figure 4:
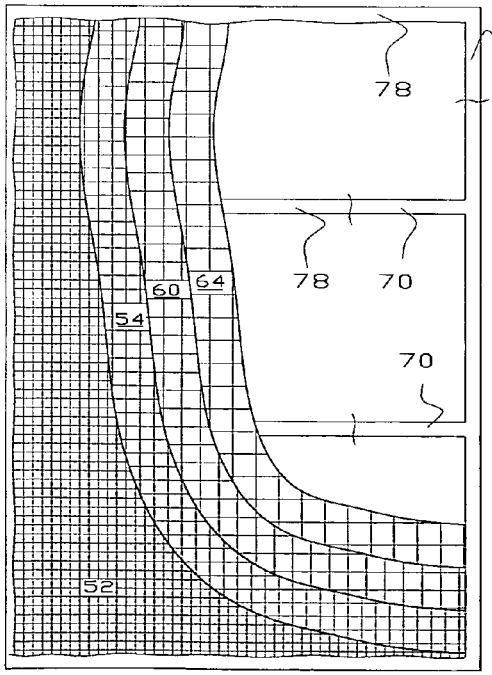
FIG. 4 is a top view of the screen assembly of FIG. 2, certain parts being broken away for clarity of illustration.
Figure 3:
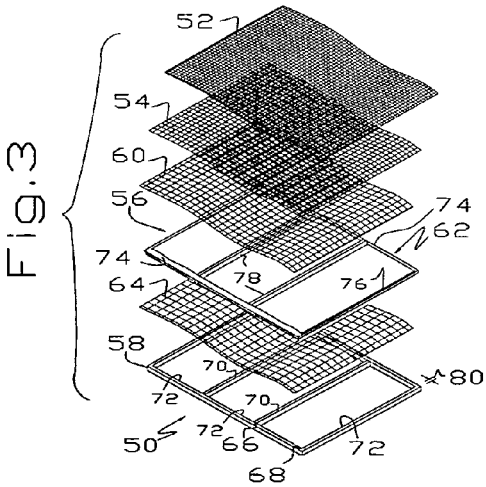
FIG. 3 is an exploded isometric view of a screen assembly of this invention.

Referring to FIGS. 3-5, a screen assembly 50 of this invention comprises an upper fine mesh screen 52, a blinding screen 54, a load bearing screen assembly 56 and a rigid frame 58.

If only one screen were employed in the screen assembly 50, the upper fine mesh screen 52 would control the cut point of the particles rejected by the assembly 50 because the size of the openings in the screen 52 would dictate the size particles that pass through the assembly 50. In a multilayer screen, this is more complicated because the wires of the blinding screen 54 and assembly 56 cross the openings of the screen 52 and make a more complex pattern of openings for the particles to pass through. This is well recognized in the art. In the past, screens were characterized by a complicated rating system which shows the proportion of particles of various size that purport to pass through the screen. Screens had rating numbers which purported to show, respectively, the diameter of spherical particles where certain proportions of the particles passed through the screen. The latest system rates screens based on the minimum size particle that is 100% rejected by the screen. Even though it is complicated, the size of the openings in the screen 52 basically dictates the size of particles rejected by the screen assembly 50.

Despite any ratings complexity, there is a clear relationship between the size of the particles that will pass through the screen 52 and the durability of the screen 52. The finer the screen mesh, the less durable the screen is because the wires are of smaller diameter. This may be seen in Table II below. This is clearly apparent from the finer mesh screens now in use. Screens of 210-280 mesh have wires that are so small that the unsupported screens are no stronger than a paper towel and without proper support will tear in less than four hours. Screens of 210-280 mesh are so slick they feel like plastic sheet.

The purpose of the blinding screen 54 is to dislodge particles that become stuck in the openings of the upper screen 52. This technique is shown in U.S. Pat. No. 4,033,865 and is now well know. The blinding screen 54 is of coarser mesh than the upper screen 52.

The purpose of the load bearing assembly 56 is to cooperate with the rigid frame 58 and support the upper screen 52 and the blinding screen 54. To this end, the load bearing assembly 56 includes a first support screen 60, a bonding material or layer 62 in the same pattern as the frame 58 and a second support screen 64. The frame 58 is rectilinear, by which is meant rectangular or square, having long frame members 66 and short perpendicular frame members 68. The frame 58 is preferably made of a rigid metal, such as square or rectangular tubing, H-beams or the like. At least two and less than ten intermediate frame members 70 span the short dimension of the frame 58 thereby separating the frame 58 into permeable sections 72 where liquids can pass through the screen assembly 50.

It will be apparent that the bonding material or layer 62 may be fabricated in several ways. First, the layer 62 may comprise a layer of adhesive, such as an epoxy or other suitable adhesive, applied to one side of the frame members 66, 68, 70 in any suitable manner, as with an automatic machine or manually with a caulking gun. Second, the bonding layer 62 may be a plastic sheet from which sections are removed corresponding to the permeable sections 72 so the layer 62 is a continuous mesh, even though the openings are rather large, meaning that the strips overlying the frame are continuous. The bonding layer 62 may comprise a series of separate or discontinuous strips overlying the frame members 66, 68, 70. Thus, the plastic layer 62 may comprise strips 74 that overlie the long frame members 66, strips 76 that overlie the short frame members 68 and strips 78 that overlie the intermediate frame members 70. It will be apparent that the plastic layer 62 may be bonded to the frame 58 by a suitable adhesive, such as an epoxy. At the current state of development, an epoxy adhesive is preferred over plastic strips because it is easier to consistently produce secure connections using epoxy than plastic strips although it is apparent that conditions and materials may change to improve the use of plastic relative to epoxy.

Even though the plastic strips 74, 76, 78 may start out as discontinuous, by the time manufacture of the screen assembly 50 is complete, the strips 74, 76, 78 will be a continuous structure intermeshed with the screens 52, 54, 60, 64. It will accordingly be seen that the permeable areas 72 are essentially free of the bonding material, meaning that the permeable areas 72 are relatively large compared to the openings 32 of the prior art screen 10.

The plastic layer 62 is of a conventional type and is conveniently of polyethylene, polypropylene or other heat fusible plastic. An important feature of this invention is that the openings between the plastic strips are of a size and spacing so that the open area of the plastic layer 62 is considerably larger than the plastic area and considerably larger than the prior art. The plastic layer 62 may start out between the first and second support screens 60, 64, may be located on the top or the bottom of the load bearing assembly 56, i.e. immediately under the blinding screen 54 or directly on top of the frame 58. Before being put into the press and heated, it is easy to see where the plastic layer 62 is located. After being bonded to the screens 52, 54, 60 and 64, it is more difficult to see whether the plastic layer 62 is above or below a particular screen because the screens and plastic layer are fused together.

The first support screen 60 is coarser than the blinding screen 54 and the second support screen 64 is coarser than the first support screen 60. This is much preferred because abrasion of the screens is reduced by making them progressively of larger mesh. For example, if the first support screen 60 were 100 mesh, then support screen 64 should be of larger mesh, e.g. 10 mesh.

The selection of the meshes for the various screens 52, 54, 60 and 64 depend on the circumstances where a particular screen assembly 50 is to be used. As mentioned previously, drilling the shallower part of the hole is done with a screen assembly of larger mesh, as suggested by the typical situations shown in Table I:

TABLE I

Mesh size selection

| | mesh size | | | |
|---|---|---|---|---|
| mud type | screen 52 | screen 54 | screen 60 | screen 64 |
| native gel mud | 50-84 | 38-50 | 10-20 | |
| lignosulfonate mud | 140-175 | 50-84 | 30-50 | 10-30 |
| invert oil emulsion | 210-250 | 100-150 | 30-50 | 6-20 |

Those skilled in the art will equate native gel muds with drilling the surface hole, lignosulfonate muds as drilling an intermediate section of the hole and invert oil emulsions with drilling the deeper part of a hydrocarbon well. It will be understood that Table I shows a typical prior art situation because current practice is to run as fine a mesh as the flow rate will allow. Although Table I is typical, often a very fine mesh, e.g. 210, screen is run from top to bottom.

There is a conventional relationship between the size of the wire employed in a screen and the mesh of the screen. As will be evident, the diameter of the wires employed in a screen become smaller as more wires are used per inch of screen. This relationship may be seen in Table II:

TABLE II

Relationship between mesh size and wire diameter

| mesh size | DX cloth wire diameter | 6S cloth wire diameter |
|---|---|---|
| 5 | .179" | |
| 25 | .014" | |
| 100 | .0045" | .008" |
| 200 | .0021" | .0014" |

Figure 1:
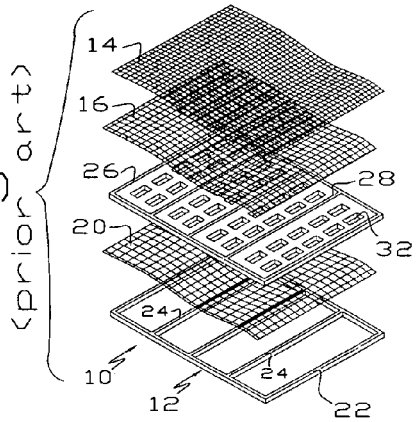
Fig.1 (prior art)
FIG. 1 is an exploded isometric view of a prior art screen assembly.

Prototypes of the screen assembly 50 have been tested in field conditions and have proved of considerably more durable than screen supported assemblies 10 of the prior art shown in FIG. 1 where the size of the openings 32 was 1" and the percentage of permeable areas was about 73%. These tests were run on the same well where the screens were placed side-by-side in the same shale shaker, giving the results shown in Table III:

TABLE III

Comparison of Operating Life of Typical Screen Assemblies

| | Screen Assembly 10 | Screen Assembly 34 | Screen Assembly 50 |
|---|---|---|---|
| native mud, shallow depth | 98 hours | 72 hours | 236 hours |
| lignosulfonate mud, med. depth | 168 hours | 96 hours | 264 hours |

In the test drilling at a medium depth using lignosulfonate mud, approximately three quarters of the flow was through the screen 50 of this invention and only one quarter was through the prior art screen 10. This illuminates an important and often overlooked point. Durability is typically measured in hours or days but the comparison is skewed by differences in volume flowing through the screen. Durability ought to be measured in terms of the volume of drilling mud passing through the screens rather than hours.

In a way, time durability and volume throughput capacity are interrelated in a subtle manner. In this invention, the screen assembly 50 has considerably greater percentage permeable area than the prior art screen 10. This means that the volume passing through each permeable square inch of the screen 50 is lower than in the prior art screen 10, which has the effect of prolonging the life of the screen because the true cause of wear of screen assemblies is the amount of volume per permeable square inch. By combining a greater permeable area and an inherently stronger screen support, durability is significantly improved.

Figure 2:
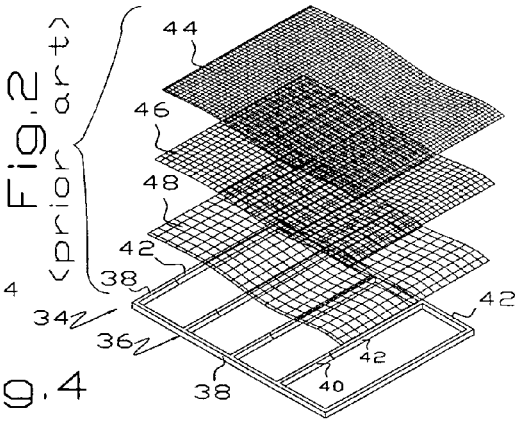
Fig.2 (prior art)
FIG. 2 is an exploded isometric view of another prior art screen assembly.

It will accordingly be seen that an important feature of this invention is that the permeable area of the screen assembly 50 is considerably larger, percentagewise, than the permeable area of the prior art screen assembly 10. This is apparent from a comparison of FIGS. 1, 2 and 3. The plastic mesh 18 has openings 32 of between 1" square and 2" square where the area between the openings 32 is impermeable, meaning that no liquid passes through these areas during use. A typical screen 10 has about 73% open area and thus about 73% permeable area. The exact plastic area and the exact area of the openings 32 will be seen to be a compromise between durability and throughput.

In this invention, the size and number of the intermediate frame members 70 will also be seen to be a compromise between durability and throughput. There are at least two intermediate frame members 70 dividing the screen assembly 50 into three permeable sections 72. A minimum sized screen assembly used in conventional rig shale shakers is 27"×45", meaning that the maximum size of each permeable area in a screen having only three openings is on the order of about 29-32% of the overall area of the assembly 50, depending largely on the width 80 of the frame members 66, 68, 70.

There are no more than ten intermediate frame members 70 dividing the screen assembly into eleven permeable sections 72. In the minimum sized screen assembly, the minimum size of each permeable area is on the order of about 8-9% of the overall area of the assembly 50, again depending somewhat on the width 80 of the frame members 66, 68. This is to be contrasted to the prior art of FIG. 1 wherein the openings are either one or four square inches in size. With a minimum sized screen assembly 10 of 27"×45", the largest openings would be 4/1215 or 0.329% of the area of the screen assembly. In the current three opening configuration of FIG. 4, the permeable area is on the order of 92% of the total area of the screen.

The prior art screens shown in U.S. Pat. No. 6,209,726 have acceptable durability even though the entire width and length of the fine mesh and blinding screens is being supported by the support screens and plastic mesh. The screen assembly 50 of this invention has exceptional durability because the unsupported distances between the frame members 66, 68, 70 is much smaller than the overall dimension of the screen assembly 50. At the same time, the screen assembly 50 has improved throughput compared to U.S. Pat. No. 6,209,726 and to the prior art screen of FIG. 1 because the permeable area of the screen is a considerably greater percentage of the overall dimension of the screen assembly.

It will be apparent that other frame configurations are equally suitable for use in this invention. Referring to FIG. 5, a screen assembly 82 comprises a frame 84 of different configuration comprising rectangular frame members 86, 88, a few intermediate members 90 extending across the short side of the frame 84 and more intermediate members 92 extending across the long side of the frame 84. The intermediate members 90, 92 accordingly divide the frame 84 into a multiplicity of permeable areas 94 covered by a fine screen 96, a blinding screen 98, a first support screen 100, a second support screen 102 and a bonding material 104 in the same manner as shown in FIG. 3.

The frame 84 of FIG. 5 is illustrated as having two intermediate frame members 90 extending across the short dimension and five intermediate frame members 92 extending across the long dimension of the frame 82 thereby providing eighteen permeable areas 94 through the screen assembly. Thus, each of the permeable areas 94 comprises approximately 4-5% of the overall area of the screen assembly 82. Additional intermediate frame members 92 may be provided so long as the permeable areas 94 don't become too small thereby increasing the non-permeable area of the screen. The minimum percentage of each permeable area of this invention is on the order of at least 2% and is preferably at least about 4%. This is in contrast to the maximum percentage of 0.329% of the prior art of FIG. 1. In the embodiment illustrated in FIG. 5 having eighteen permeable areas, the total permeable area is about 76% of the overall area of the screen assembly 82.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A screening assembly comprising a rigid rectilinear frame comprising end members, side members perpendicular to the end members and at least two and not more than ten intermediate members spanning the frame between the side members, the end, side and intermediate members being arranged in a pattern;

a screen assembly covering the frame including an upper fine mesh screen, a blinding screen, below the fine mesh screen, of coarser mesh than the fine mesh screen and at least a pair of load bearing screens for the fine mesh and blinding screens, below the blinding screen, including a first support screen of coarser mesh than the blinding screen and a second support screen of coarser mesh than the first support screen; and a layer of heat fusible plastic of the same pattern as the frame members dispersed between the screens thereby bonding the screens together and an adhesive on the frame members bonded to the heat fusible plastic and thereby bonding the screens to the frame members, areas between the frame members being substantially free of bonding material thereby increasing permeable area of the screen and increasing screening capacity;

the flow path through the screening assembly being through the fine mesh screen, through the blinding screen and then through the load bearing screens.

2. The screening assembly of claim 1 wherein the frame comprises at least one intermediate member spanning the frame between the end members.

3. The screening assembly of claim 1 wherein the frame is free of an intermediate member spanning the frame between the end members.

4. The screening assembly of claim 1 wherein the frame members are tubing of rectilinear cross-section.

5. The screening assembly of claim 1 wherein the frame members are linear.

6. The screening assembly of claim 1 wherein the rectilinear frame is rectangular.

7. The screening assembly of claim 1 wherein the frame comprises metal tubing.

8. The screening assembly of claim 1 wherein the heat fusible plastic is selected from the group consisting of polyethylene and polypropylene.

9. The screening assembly of claim 8 wherein the adhesive is an epoxy adhesive.

10. A screening assembly comprising a rigid rectilinear frame comprising end members, side members perpendicular to the end members and a plurality of intermediate members spanning the frame between the side members defining a series of permeable openings through the frame, the end, side and intermediate members being arranged in a pattern, the area of each of the permeable openings being between 2-32% of the area of the frame;

a screen assembly covering the frame including an upper fine mesh screen, a blinding screen, below the fine mesh screen, of coarser mesh than the fine mesh screen and at least a pair of load bearing screens for the fine mesh and blinding screens, below the blinding screen, including a first support screen of coarser mesh than the blinding screen and a second support screen of coarser mesh than the first support screen; and a layer of heat fusible plastic of the same pattern as the frame dispersed between the screens thereby bonding the screens together and an adhesive on the frame members bonded to the heat fusible plastic and thereby bonding the screens to the frame members, areas between the frame members being substantially free of bonding material thereby increasing permeable area of the screen and increasing screening capacity;

the flow path through the screening assembly being through the fine mesh screen, through the blinding screen and then through the load bearing screens.

11. The screening assembly of claim 10 wherein the area of each of the permeable openings is between 4-32% of the area of the frame.

12. The screening assembly of claim 10 wherein the area of each of the permeable openings is between 8-32% of the area of the frame.

13. The screening assembly of claim 10 wherein the heat fusible plastic is selected from the group consisting of polyethylene and polypropylene.

14. The screening assembly of claim 13 wherein the adhesive is an epoxy adhesive.

* * * * *